US008323438B2

(12) United States Patent
Roof et al.

(10) Patent No.: US 8,323,438 B2
(45) Date of Patent: Dec. 4, 2012

(54) METHOD FOR FIXING A RADIATION-CURABLE GEL-INK IMAGE ON A SUBSTRATE

(75) Inventors: Bryan J Roof, Newark, NY (US); Steven E Ready, Los Altos, CA (US); Jurgen H Daniel, San Francisco, CA (US); Gregory J Kovacs, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 437 days.

(21) Appl. No.: 12/256,690

(22) Filed: Oct. 23, 2008

(65) Prior Publication Data

US 2010/0101716 A1 Apr. 29, 2010

(51) Int. Cl.
*B41J 2/425* (2006.01)
*B41J 2/01* (2006.01)

(52) U.S. Cl. ..... 156/247; 347/99; 347/102; 347/156; 427/511; 156/277

(58) Field of Classification Search ..... 156/272.2, 156/273.7, 275.5, 277, 247, 269, 324, 701, 156/719; 347/102, 88, 99, 156; 427/495, 427/511; 101/491
See application file for complete search history.

(56) References Cited

U.S. PATENT DOCUMENTS

| | | | | |
|---|---|---|---|---|
| 3,811,828 | A * | 5/1974 | Ohta et al. | 432/227 |
| 4,606,962 | A * | 8/1986 | Reylek et al. | 428/148 |
| 5,121,139 | A * | 6/1992 | Burke | 346/138 |
| 5,662,574 | A * | 9/1997 | Slotten | 492/56 |
| 6,355,203 | B1 * | 3/2002 | Charmes et al. | 264/493 |
| 2004/0189773 | A1 | 9/2004 | Masumi et al. | |
| 2006/0066703 | A1 | 3/2006 | Kadomatsu et al. | |
| 2006/0090843 | A1 * | 5/2006 | Steinhardt et al. | 156/247 |
| 2006/0115305 | A1 * | 6/2006 | Lofthus et al. | 399/328 |
| 2006/0132570 | A1 * | 6/2006 | Odell et al. | 347/102 |
| 2006/0290760 | A1 * | 12/2006 | German et al. | 347/102 |
| 2007/0120930 | A1 * | 5/2007 | Domoto et al. | 347/102 |
| 2008/0122914 | A1 | 5/2008 | Toma | |

OTHER PUBLICATIONS

European Search Report Dated Feb. 18, 2010, Issued in Connection with Related EP Application No. 09173772.6.

* cited by examiner

*Primary Examiner* — John Goff
*Assistant Examiner* — Scott W Dodds
(74) *Attorney, Agent, or Firm* — Ronald E. Prass, Jr.; Prass LLP

(57) ABSTRACT

An apparatus fixes ink on a substrate, such as in ink-jet printing. A leveling member is positioned to contact an ink-bearing side of the substrate at a nip. A radiation source is positioned to direct radiation to the ink-bearing side of the substrate at the nip, the radiation suitable for curing the ink on the substrate.

20 Claims, 2 Drawing Sheets

METHOD FOR FIXING A RADIATION-CURABLE GEL-INK IMAGE ON A SUBSTRATE

CROSS-REFERENCE TO RELATED APPLICATIONS

Cross-reference is hereby made to the following US Patent Applications, assigned to the assignee hereof: U.S. application Ser. No. 12/256,670, U.S. application Ser. No. 12/256,654 being filed simultaneously herewith; and U.S. application Ser. No. 11/291,284, filed Nov. 30, 2005, now US Patent Application Publication US 2007/0120930 A1.

INCORPORATION BY REFERENCE

The following documents are incorporated by reference in their entireties for the teachings therein: US Patent Application Publication US 2007/0120930 A1; and US Patent Application Publication US 2008/0122914 A1.

TECHNICAL FIELD

The present disclosure relates to printing with radiation-curable inks.

BACKGROUND

US Patent Application Publication US 2008/0122914 A1 discloses compositions for an ultraviolet (UV)-curable ink suitable for use in ink-jet printing. Such inks include one or more co-monomers and a gellant. When exposed to radiation of a predetermined frequency, these co-monomers polymerize and thus bind to any number of types of surfaces. In practical applications, such inks have a viscous property at room temperature, but become more liquid when heated for jetting onto a substrate to form images.

US Patent Application Publication US 2007/0120930 A1 discloses a printing apparatus suitable for use with a radiation-curable ink. The apparatus uses a "transfuse" system, wherein ink forming the desired image is first jetted onto an image receptor in the form of a belt, and then transferred from the image receptor onto a print sheet or other substrate. At various locations along the belt path are disposed ultraviolet radiation sources for partially hardening the ink on the belt before transferring to the print sheet.

Although the above-described apparatus uses an image receptor to apply ink to a print sheet, it would be desirable to provide a system where such an ink as above described could be applied directly to a print sheet or other substrate. One challenge to such a system is that, in practical applications, such inks tend to have a "mayonnaise" consistency at room temperature, but when heated incidental to jetting, change to a low viscosity liquid. A typical ink-jet printing process heats the ink until it is liquid and then directly fires ink droplets from a piezoelectric print head onto the substrate. Once the ejected ink hits the substrate, it changes phase from the liquid back to its more viscous consistency, thereby reducing its penetration into porous media. Once this ink is exposed to UV radiation, photoinitiators in the ink are bombarded with UV radiation and the incident flux converts the monomers present in the ink into a cross linked polymer matrix resulting in a very hard and durable mark on the paper.

However, there is a desire to have the ink leveled prior to having it UV cured. The reason for this is so that gloss is more uniform, missing jets can be masked, and certain applications such as packaging require thin layers of relatively constant thickness. Since these inks have a mayonnaise consistency, they have very little cohesive strength prior to curing. In addition, the inks are typically designed to have good affinity to many materials. This means that conventional methods for flattening a layer of ink tend to fail, because the ink splits and leaves much of the image behind on the device trying to flatten it, such as a traditional fuser roll as familiar in xerography. The present description proposes a way to resolve this issue.

SUMMARY

According to one aspect, there is provided a method of printing on a substrate, comprising: applying ink onto a main surface of the substrate according to image data; applying to the main surface of the substrate a web, the web being substantially transmissive of radiant energy; applying pressure of a predetermined magnitude to the web and the substrate; applying radiant energy to the web and the substrate; and separating the web and the substrate.

DETAILED DESCRIPTION

Figure 1:
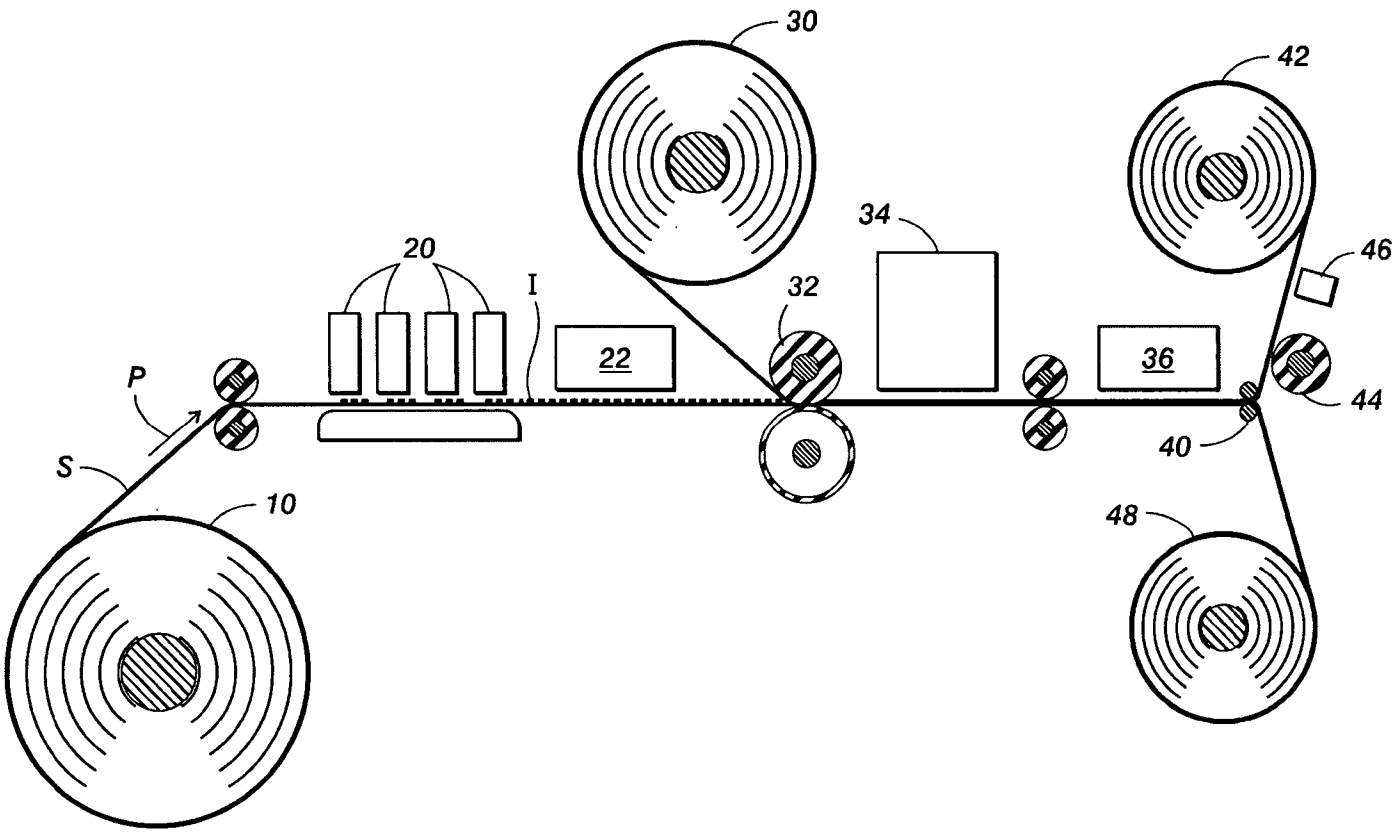
FIG. 1 is a simplified elevational view of a fixing apparatus, as would be found in a larger printing apparatus, according to an embodiment.

FIG. 1 is a simplified elevational view of a printing system. A substrate S, such as of paper or other material on which images are desired to be printed, is spooled off a roll 10. The substrate S is conducted, through a process direction P, to a series of ink-jet printheads 20, which are operated to place different color separations, building to a desired full-color image according to input digital data, onto a main surface of the substrate S. (In the Figure, the ink on substrate S is indicated as I.) Although a "direct-to-paper" arrangement of printheads 20 is shown, in alternate embodiments (not shown) the printheads can direct ink in imagewise fashion first onto an intermediate member such as a drum, which in turn transfers the complete color image onto the substrate S. In alternative embodiments, other basic printing technologies, such as offset or flexographic, can be used to place the ink on the substrate S as well.

In the present embodiment the ink I comprises an ultraviolet (UV)-curable ink, an example of which is described in US Patent Application Publication US 2008/0122914 A1. One embodiment of such an ink includes one or more co-monomers and a gellant. When exposed to radiation of a predetermined frequency, these co-monomers polymerize and thus bind to any number of types of surfaces. In practical applications, such inks have a viscous property at room temperature, but become more liquid when heated for jetting onto a substrate to form images.

Downstream of the printheads 20 along process direction P, there may be disposed a heater 22 that brings the ink I to a predetermined temperature; the precise temperature will depend on the particular composition of the ink I and the desired viscosity or other properties of the ink in the following process.

Following the adjustment of the ink I to a desired temperature, there is applied to the ink-bearing surface of substrate S a web 30. As shown, the web 30 is in the present embodiment unwound from a spool. At or around the point of contact between the web 30 and substrate S, a spreader 32, here comprising two rolls forming a nip, applies a pressure of predetermined magnitude to the web 30 and substrate S, causing the ink I to be squeezed between the web 30 and substrate S.

The web 30 has distinct physical properties. The web 30 should provide a low surface energy, hydrophobic surface against the ink I. Depending on the material set for an embodiment, it may also be desired that the web 30 provide an oleophobic surface. The web should be transmissive of radiant energy, particularly ultraviolet light in this embodiment. As of the filing hereof, suitable materials for the web 30 include clear, thin Mylar®, or a UV-transmissive polyimide. Another material exhibiting some desirable properties for this purpose is the UV-transmitting acrylic sheet available as ACRYLITE® OP-4 from CYRO industries, marketed for use in indoor sun-tanning equipment. The selection of material will be affected by considerations such as expense and physical durability for multiple uses.

Once the web 30 is urged against substrate S at spreader 32, the ink I can be cured by the application of radiant energy, such as ultraviolet light, such as by a UV curing station 34. In one embodiment, the curing station 34 can includes either an LED array or lamps, to emit UV or other radiant energy. Because the web 30 is transmissive of radiant energy, the UV or other radiant energy from curing station 34 passes through web 30 to cure ink I on substrate S. In an alternative embodiment, the functions of spreader 32 and curing station 34 can be combined in a device similar to that described in U.S. application Ser. No. 12/256,684. A second heater 36 can also adjust the temperature of the web 30 and substrate S as needed following curing.

Further along process direction P, the web 30 is separated from the substrate S at separation rolls 40. Because the web 30 is of low surface energy and is hydrophobic and/or oleophobic, and since the ink I has been cured on the surface of substrate S, mechanical removal of web 30 can be made highly efficient with regard to avoiding any offset of cured ink I when the web 30 is separated. In the present embodiment, the removed web 30 is directed to a take-up spool 42 while the substrate S is gathered up on take-up spool 48, but it is conceivable that the web 30 could be in the form of a continuous belt, suitable for re-application to the substrate S back at spreader 32. In any case, there may be provided a cleaning roll 44 for cleaning the web 30 following separation, as well as a "release refresher" 46, for applying some sort of release agent onto the web 30 that will be useful when the web 30 is reused. Examples of release agents useful in this context include a spray-on coating of fluorocarbon flakes or particles, or a thin layer of silicone oil.

Figure 2:
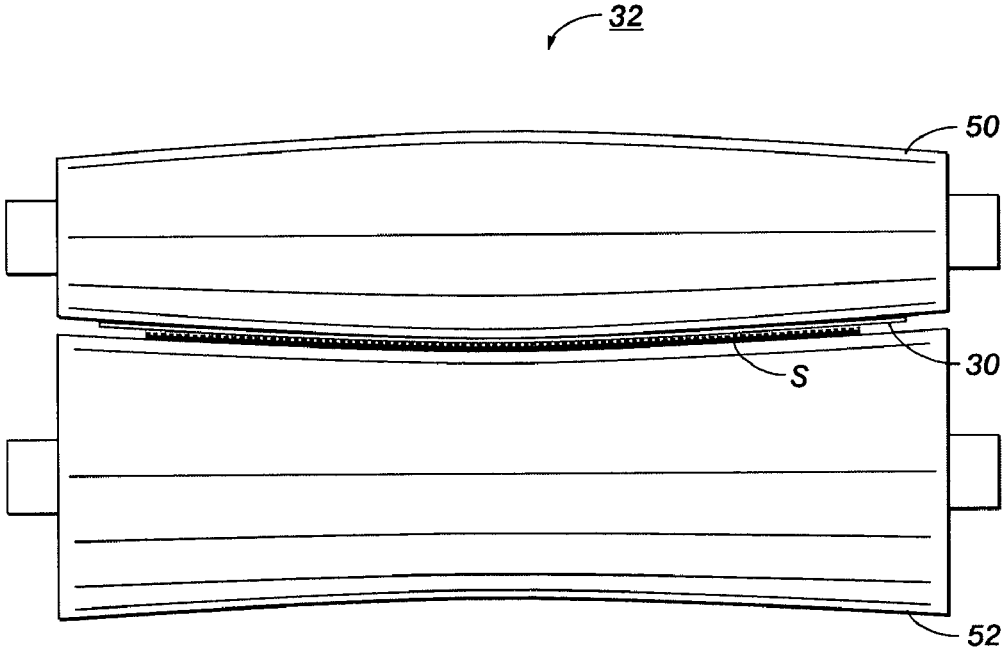
FIG. 2 is an orthogonal view of one embodiment of a spreader as would be used in an embodiment.

FIG. 2 is an orthogonal view of one embodiment of a spreader 32 such as described above. One practical concern in the present embodiment is the ability to keep the substrate S and web 30 registered to each other during the process, such that there is no relative motion between the substrate S and web 30 that would result in an image disturbance. If the rolls 50, 52 in spreader 32 are profiled, as shown, such that a curvature is formed in the web/substrate "sandwich" the increased strength of the sandwich will reduce the tendency for relative motion between the substrate S and web 30. (As used herein, "profiled" shall mean simply that one roll has other than a simple cylindrical shape.) In the illustrated embodiment, the web-side roll 50 has a concave profile and the substrate-side roll 52 has a convex profile, but the specific shapes of the rolls can be adapted for a given implementation. The effective shape of either roll can be created by relative hardness of one roll against the other. These profiled rolls can be employed in the spreader 32 as shown, or in any roller pair wherever the substrate S and web 30 are in contact with each other.

Further, regardless of the profiling of the rolls, if the substrate S and web 30 are of different widths, as shown in FIG. 2, positive traction can be maintained with at least one of the substrate S and web 30 as the sandwich passes through a roller pair.

In an alternative embodiment, the spreader 32 or any roller pair can include, instead of a roll pair, a roll- or belt-based vacuum transport system. Although the illustrated embodiment shows a vertical-shooting printhead and a horizontal substrate path, the apparatus can be arranged with a horizontal-shooting printhead and a vertical substrate path; or the active portion of the apparatus can be disposed along a portion of the circumference of a large drum.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of printing on a substrate using a radiation curable phase change ink suitable for ink jet printing, comprising:

applying the phase change ink directly onto a main surface of the substrate according to image data to form an uncured ink image on the substrate that corresponds to the image data;

applying to the main surface of the substrate a web, the web being substantially transmissive of radiant energy, the web comprising an ink contact surface, the ink contact surface defining a low surface energy contact surface against the ink;

applying pressure of a predetermined magnitude to the web and the substrate to level the ink of the uncured ink image;

applying radiant energy to the web and the substrate, after the applying pressure of a predetermined magnitude, to cure the leveled, uncured ink image on the substrate; and separating the web and the substrate wherein the ink is prevented from offsetting to the web during the separating.

2. The method of claim 1, further comprising:

following applying the ink, bringing the ink to a predetermined temperature before applying the web.

3. The method of claim 1, wherein the ink contact surface of the web is hydrophobic.

4. The method of claim 1, wherein the web substantially comprises at least one of a polyimide or an acrylic.

5. The method of claim 1, further comprising:

adjusting the temperature of the web and the substrate following the application of radiant energy.

6. The method of claim 1, wherein the applying pressure is performed by a spreader, the spreader comprising at least two rolls forming a nip for the passage of the substrate and the web therethrough.

7. The method of claim 6, wherein at least one of the rolls is profiled to minimize relative movement between the web and the substrate to minimize disturbance of the ink image.

8. The method of claim 1, wherein the substrate and the web are of different widths.

9. The method of claim 1, wherein the ink is applied directly to the main surface of the substrate with printheads.

10. The method of claim 1, wherein the ink is UV-curable and comprises one or more co-monomers and a gellant.

11. The method of claim 10, wherein the image is a full-color digital image.

12. The method of claim 1, wherein:

the radiant energy is applied to the web and the substrate at a location downstream from where the pressure is applied to the web and the substrate; and the web and the substrate are separated at a location downstream from the location at which the radiant energy is applied to the web and the substrate.

13. The method of claim 6, wherein the radiant energy is applied to the web and the substrate downstream from the nip of the spreader, and after the applying a pressure of a predetermined magnitude to the web and the substrate.

14. The method of claim 6, wherein the web and the substrate are separated downstream from the nip of the spreader.

15. The method of claim 6, wherein:

the radiant energy is applied to the web and the substrate to cure the ink by a curing station downstream from the nip of the spreader; and the web and the substrate are separated downstream from the curing station, and after the applying radiant energy to the web.

16. The method of claim 15, wherein:

the ink is UV-curable and comprises one or more co-monomers and a gellant; and the ink is applied directly to the main surface of the substrate with printheads.

17. The method of claim 16, the separating the web and the substrate further comprising:

the web and the substrate being separated by separation rolls.

18. The method of claim 6, the separating further comprising:

removing the web from the substrate after the applying radiant energy; and uptaking the web by an uptake spool after removing the web from the substrate, the web defining a low surface energy, hydrophobic surface against the ink before the separating.

19. The method of claim 1, wherein the ink contact surface of web is oleophobic.

20. A radiation curable phase change ink leveling method for producing a uniform layer of gel ink, the method comprising:

depositing gel ink directly onto a substrate from a print head;

contacting the gel ink with a web, the web being formed to provide a low surface energy surface against the gel ink;

leveling the gel ink by squeezing the ink between the web and the substrate at a fusing nip, the fusing nip comprising a fusing member, the leveling comprising applying pressure against the web to squeeze the ink;

irradiating the ink to cure the ink after the ink enters the fusing nip; and separating the web from the ink at a position downstream from the fusing nip, the separating comprising removing the web from the ink after the ink exits the fusing nip whereby the ink is prevented from adhering to the web and the fusing member, and whereby an ink image formed by the leveled, irradiated ink is substantially free of cracks.

* * * * *

UNITED STATES PATENT AND TRADEMARK OFFICE

CERTIFICATE OF CORRECTION

PATENT NO. : 8,323,438 B2
APPLICATION NO. : 12/256690
DATED : December 4, 2012
INVENTOR(S) : Bryan J. Roof et al.

It is certified that error appears in the above-identified patent and that said Letters Patent is hereby corrected as shown below:

On the Title page, Item (73) Assignee should read

-- Xerox Corporation, Norwalk, CT (US); and
Palo Alto Research Center Incorporated, Palo Alto, CA (US) --

Signed and Sealed this
Twenty-seventh Day of May, 2014

Michelle K. Lee

Michelle K. Lee
*Deputy Director of the United States Patent and Trademark Office*